US006588394B2

(12) United States Patent
Zheng

(10) Patent No.: US 6,588,394 B2
(45) Date of Patent: Jul. 8, 2003

(54) MODEL-BASED CONTROL OF A SOLENOID-OPERATED HYDRAULIC ACTUATOR FOR ENGINE CYLINDER DEACTIVATION

(75) Inventor: Quan Zheng, Ann Arbor, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/953,090

(22) Filed: Sep. 14, 2001

(65) Prior Publication Data

US 2002/0096139 A1 Jul. 25, 2002

Related U.S. Application Data

(60) Provisional application No. 60/234,863, filed on Sep. 22, 2000.

(51) Int. Cl.[7] ..... F01L 1/34

(52) U.S. Cl. ..... 123/198 F; 123/90.16

(58) Field of Search ..... 123/198 F, 90.16, 123/90.15, 90.17, 90.39, 90.44, 90.18, 90.27

(56) References Cited

U.S. PATENT DOCUMENTS 4,534,323 A * 8/1985 Kato et al. ..... 123/90.16
4,584,974 A * 4/1986 Aoyama et al. ..... 123/90.16
6,138,636 A * 10/2000 Kohno et al. ..... 123/198 F
6,196,175 B1 * 3/2001 Church ..... 123/90.16
6,325,030 B1 * 12/2001 Spath et al. ..... 123/90.16

* cited by examiner

*Primary Examiner*—Henry C. Yuen
*Assistant Examiner*—Hyder Ali
(74) *Attorney, Agent, or Firm*—Vincent A. Chicosz

(57) ABSTRACT

An improved control method for a solenoid-operated hydraulic actuator for deactivating an engine valve mechanism characterizes the dynamic response of the mechanism based on a lumped parameter model of the solenoid, the hydraulic sub-system, and a locking pin mechanism actuated by a control pressure developed by the hydraulic sub-system. In response to a mode change request, constituent delay times associated with the solenoid, the hydraulic sub-system, and the locking pin mechanism are determined and summed to form an estimate of the overall delay time required to complete the requested cylinder deactivation. The solenoid activation is then scheduled based on the estimated delay time and a window of opportunity in the engine cycle for cylinder deactivation.

7 Claims, 4 Drawing Sheets

MODEL-BASED CONTROL OF A SOLENOID-OPERATED HYDRAULIC ACTUATOR FOR ENGINE CYLINDER DEACTIVATION

This application claims the benefit of Provisional Application No. 60/234,863, filed Sep. 22, 2000.

TECHNICAL FIELD

The present invention is directed to selective deactivation of specified cylinders of an internal combustion engine with a solenoid activated hydraulic actuator that disables intake and exhaust valve lifters, and more particularly to a model-based method of controlling the actuator based on an estimation of the actuator response time.

BACKGROUND OF THE INVENTION

It is known that fuel economy improvements may be achieved in multi-cylinder internal combustion engines by deactivating selected cylinders during specified engine operating conditions. For example, General Motors Corporation produced engines for 1980 Cadillac vehicles capable of operation with four, six or eight cylinders, depending on engine speed and load. In mechanizing a cylinder deactivation system in an engine with cam-driven valve lifters, the valve lifters for the intake and exhaust valves of a cylinder capable of being deactivated are equipped with solenoid activated hydraulic actuators that when activated, prevent the valves from opening.

In operation, the valve deactivation hardware is actuated in response to a command to deactivate the respective valves, and the actuation must be completed within a given window of opportunity relative to the respective cylinder combustion cycle. In a typical system, for example, the intake and exhaust valves for a cylinder to be deactivated are locked in a closed state during the combustion/power stroke, and prior to the exhaust stroke. To reliably carry out such a method, the controller must have a reasonably accurate estimation of the dynamic response time of the deactivation hardware. However, it is difficult to accurately calibrate or estimate the dynamic response time since it can vary significantly due to variations in the fluid source pressure, temperature, system voltage, and so on. Accordingly, what is needed is a control method based on a more accurate estimation of the overall response time of cylinder deactivation.

SUMMARY OF THE INVENTION

The present invention is directed to an improved control method in which the dynamic response of a solenoid-operated hydraulic actuator for deactivating an engine valve mechanism is characterized using a lumped parameter model of the solenoid, the hydraulic sub-system, and a locking pin mechanism actuated by a control pressure developed by the hydraulic sub-system. In response to a mode change request, constituent delay times associated with the solenoid, the hydraulic sub-system, and the locking pin mechanism are determined and summed to form an estimate of the overall delay time required to complete the requested cylinder deactivation. The solenoid activation is then scheduled based on the estimated delay time and a window of opportunity in the engine cycle for cylinder deactivation.

DESCRIPTION OF THE PREFERRED EMBODIMENT

Figure 1A:
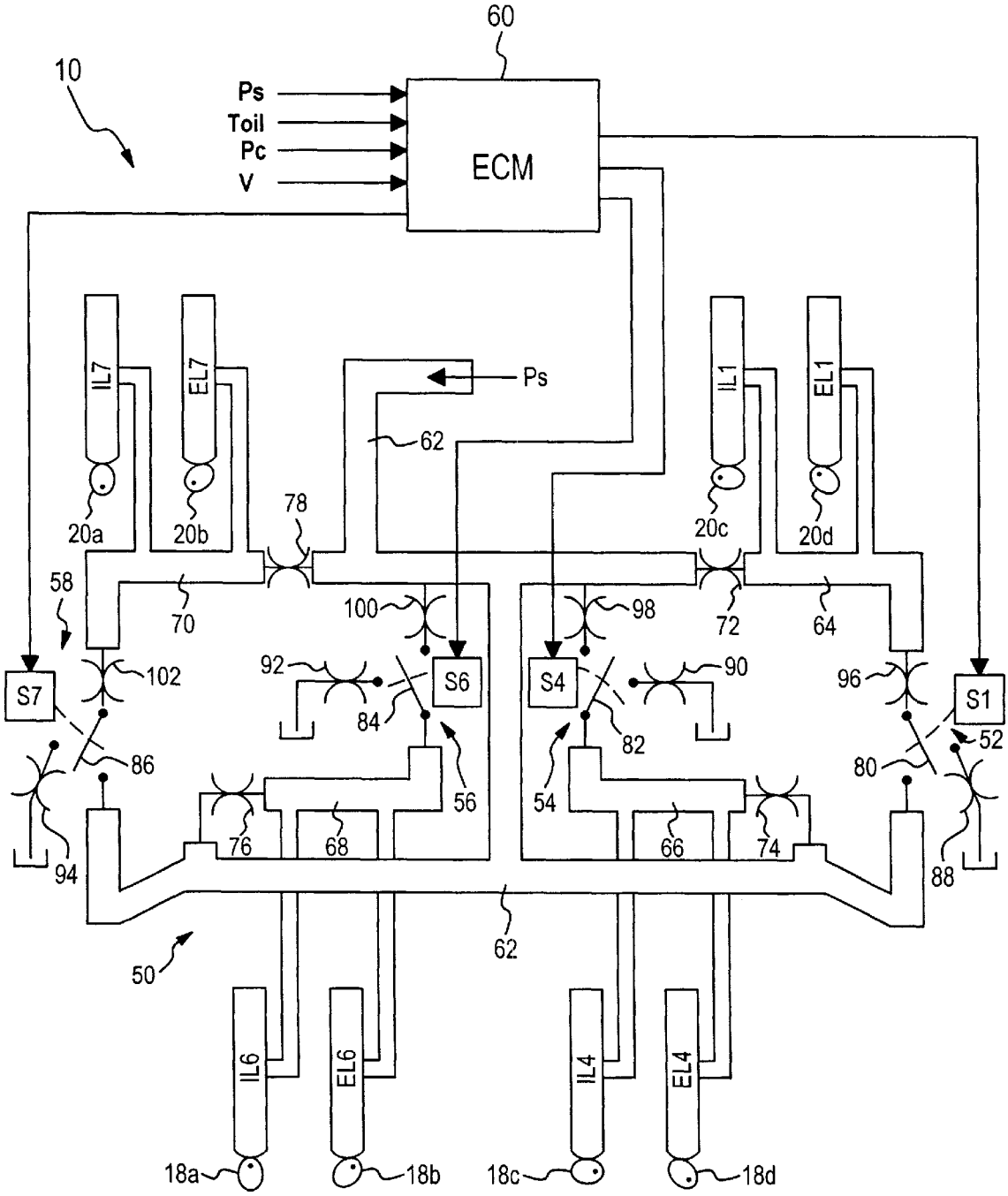
FIG. 1A PRIOR ART
FIG. 1A is a diagram of a prior art engine cylinder deactivation system including hydraulic intake and exhaust valve lifters equipped with solenoid operated hydraulic actuators for selectively preventing valve opening, and a microprocessor-based control unit for controlling solenoid energization in response to a cylinder activation/deactivation command.
Figure 1B:
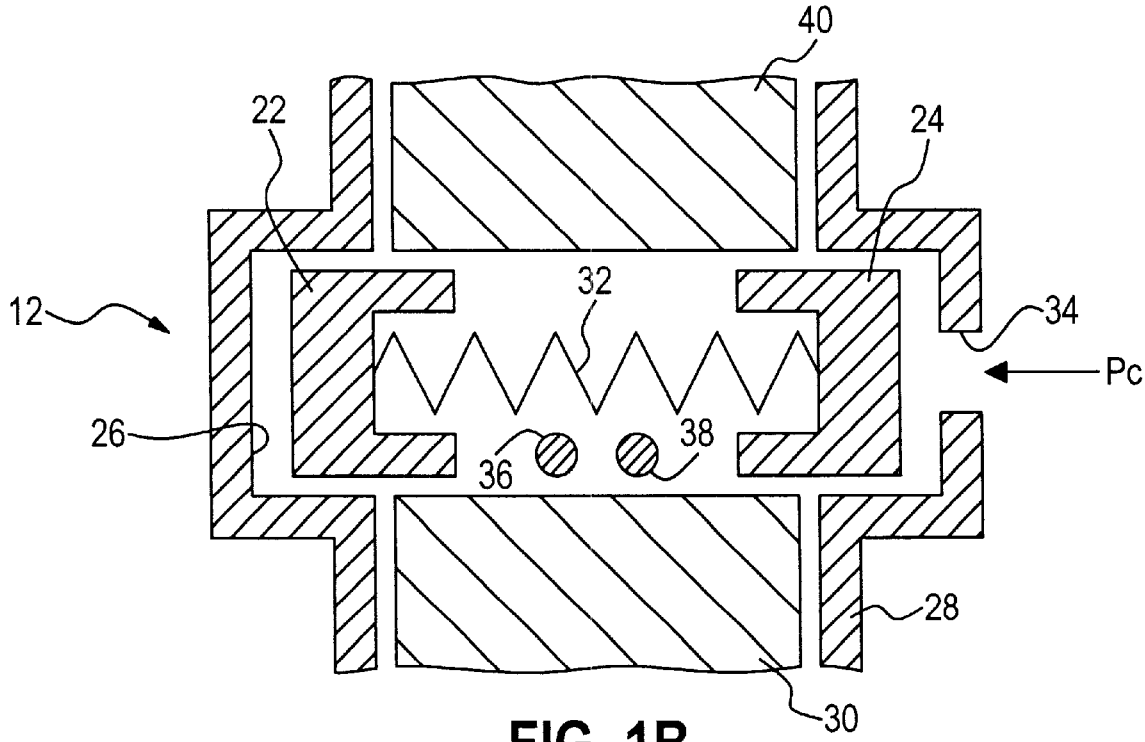
FIG. 1B PRIOR ART
FIG. 1B is a cross-sectional diagram of a hydraulic actuator of FIG. 1A.

Referring to FIG. 1A–1B, the method of the present invention is described in the context of a valvetrain deactivation system 10 in which intake and exhaust valves of specified engine cylinders are locked in a closed position to essentially deactivate the specified cylinders. In general, cylinder selection for deactivation is determined by engine firing order and the desire to maintain an even firing order after the specified cylinders have been deactivated. In the illustrated embodiment, the engine being controlled has two banks of four cylinders (i.e., a V8 engine); two specified cylinders from each bank are subject to selective deactivation, and the specified cylinders are consecutively deactivated in response to a mode change request. Also, the illustrated engine has only one intake valve and one exhaust valve per cylinder.

FIG. 1A depicts the intake and exhaust valve lifters IL1, EL1; IL4, EL4; IL6, EL6; and IL7, EL7 for cylinder numbers 1, 4, 6 and 7 of a V8 engine, each such lifter being equipped with a hydraulically activated locking pin mechanism 12, as depicted in FIG. 1B. Each such valve lifter is mechanically actuated by a respective lobe 18*a*, 18*b*; 18*c*, 18*d*; 20*a*, 20*b*; 20*c*, 20*d* of a rotating camshaft, and in each case, the locking pin mechanism 12 can be positioned to either make or break a mechanical connection between the respective camshaft lobe and a respective valve. Referring to FIG. 1B, the locking pin mechanism 12 may be configured as a pair of shoes 22, 24 slidably disposed within a cavity 26 of an outer case 28 of an intake or exhaust lifter. The outer case 28 is mechanically coupled to a valve, and an inner member 30 slidably disposed within the axial bore of outer case 28 is mechanically coupled to a respective camshaft lobe. The shoes 22, 24 are biased apart by a spring 32 to a position that permits the transfer of linear motion from the camshaft lobe to the valve through the inner member 30, the shoes 22, 24 and the outer case 28. Hydraulic pressure supplied to a port 34 of the cavity 26 acts on the peripheral surfaces of shoes 22, 24, producing a force that opposes spring 32; if the inner member 30 is in the depicted position (that is, if the base circle of the camshaft lobe is contacting the inner member 30), the shoes 22, 24 are free to move, and the hydraulic force displaces the shoes 22, 24 inwardly until limited by the stops 36, 38. In this position, the shoes 22, 24 no longer couple inner member 30 to outer case 28; consequently, linear motion of the camshaft lobe is no longer coupled to the respective valve, and such valve remains closed. Instead, the shoes 22, 24 transfer the axial motion of inner member 30 to inner member 40, which is biased to the position shown in FIG. 1B to maintain the shoes 22, 24 properly positioned within the cavity 26 when the inner members 30 and 40 move back to the depicted positions. When the camshaft lobe is contacting a valve lifter on a point other than the base circle of the lobe, the shoes 22, 24 are transmitting cam motion as described above, and cannot be deactivated.

Referring back to FIG. 1A, the valvetrain deactivation system 10 additionally comprises a hydraulic system 50 capable of coupling a source of fluid pressure Ps (which may be engine oil pressure) to the locking pin mechanism 12 of each lifter IL1, EL1; IL4, EL4; IL6, EL6; IL7, EL7, a set of solenoid-operated valves 52, 54, 56, 58, and a microprocessor-based engine control module (ECM) 60 for activating the solenoid-operated valves 52, 54, 56, 58 in response to a mode change request. The fluid pressure Ps is supplied to a supply pressure plenum 62, and fluid in the plenum 62 is supplied to control chambers 64, 66, 68, 70 for each of the cylinders subject to deactivation through respective charge orifices 72, 74, 76, 78. The solenoid-operated valves 52, 54, 56, 58 are schematically depicted, each including an electrically-activated solenoid coil S1, S4, S6, S7 electrically coupled to ECM 60 and a shiftable fluid conduit 80, 82, 84, 86 for selectively coupling the respective control chamber 64, 66, 68, 70 to an exhaust orifice 88, 90, 92, 94 or to a supply pressure orifice 96, 98, 100, 102. And in each case, the shiftable conduit 80, 82, 84, 86 is mechanically biased to a position that exhausts the respective control chamber 64, 66, 68, 70. The fluid pressure in each control chamber 64, 66, 68, 70 thus has a base or default value determined by the relative areas of charge orifices 72, 74, 76, 78 and exhaust orifices 88, 90, 92, 94 that is insufficient to overcome the force of spring 32 in the respective locking pin mechanism 12. However, when one or more of the solenoid coils S1, S4, S6, S7 are electrically activated to change the valve state, the fluid pressure in the respective control chamber 64, 66, 68, 70 increases substantially to the supply pressure Ps, producing a force that is sufficient to overcome the force of spring 32 in the respective locking pin mechanism 12, provided that the inner member 30 is contacting the base circle of the respective camshaft lobe.

When controlling an engine equipped with the above-described system 10, the overall time response of the system must be known in order to ensure that the specified cylinders are reliably activated and deactivated, and in order to coordinate the deactivation hardware with other engine control functions such as spark timing and fuel delivery. For example, when a change mode request is generated, ECM 60 must determine the overall response time of the system 10 in order to determine if there is time to activate the mechanical pin mechanisms 12 in the up-coming window of opportunity in the engine crank cycle. If there is not sufficient time, the ECM 60 must wait until the next window of opportunity. If there is sufficient time, the ECM 60 must command activation of the solenoid valves 52, 54, 56, 58, disable fuel delivery to the specified cylinders, and suitably adjust the spark timing for the other cylinders. Unfortunately, accurate characterization of the overall response time is not easily achieved since laboratory testing cannot encompass the various combinations of engine and system parameters that affect response time. According to the present invention, this difficulty is overcome by modeling the dynamic behavior of the deactivation system hardware to accurately estimate the overall response time for any combination of the various parameters that affect response time. The overall response time includes three components: the solenoid valve response time, the hydraulic system response time, and the locking pin mechanism response time.

Figure 2:
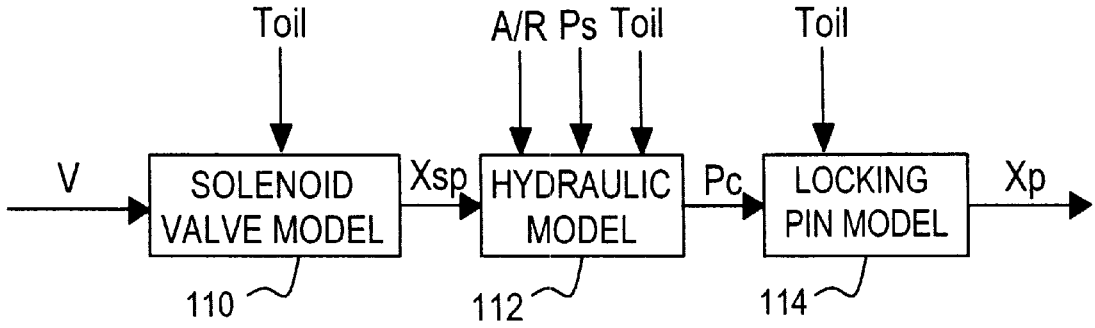
FIG. 2 is a block diagram of a dynamic model according to this invention.

As shown in FIG. 2, the system 10 can essentially be modeled as a series of three subsystems: solenoid valve subsystem 110, a hydraulic subsystem model 112, and locking pin subsystem 114. On receipt of a mode change request (i.e., a request to deactivate specified engine cylinders), ECM 60 supplies a solenoid activation voltage signal v to the solenoid valve subsystem 110, which outputs a valve spool displacement signal $x_{sp}$ indicative of the resulting movement of a solenoid valve 52, 54, 56, 58. The output $x_{sp}$ is applied as an input to the hydraulic subsystem model 112 along with other inputs indicative of the air ratio A/R in control chambers 64, 66, 68, 70, the supply pressure $P_S$ and the fluid temperature $T_{oil}$. Based on such inputs, the hydraulic system model 112 outputs a control pressure signal Pc indicative of the resulting pressure in a control chamber 64, 66, 68, 70. The Pc signal is supplied as an input to the locking pin subsystem model 114, which outputs a displacement signal Xp indicative of the resulting movement of shoes 22, 24. The overall response time begins when mode change request is received and ends when the signal Xp indicates that the shoes 22, 24 have been fully displaced.

The solenoid subsystem model 110 takes into account the mechanical, electrical, and electromagnetic aspects of the solenoid valves 52, 54, 56, 58. The mechanical aspects are represented by the force balance equation:

$$m_{sp}\cdot x_{sp}+B_{sp}\cdot x_{sp}+K_{sp}\cdot x_{sp}=F_{EMF}-F_f-F_{preload} \tag{1}$$

where:

$x_{sp}$ is the solenoid plunger displacement $m_{sp}$ is the mass of solenoid plunger $B_{sp}$ is the damping coefficient of solenoid plunger $K_{sp}$ is the spring coefficient of solenoid plunger spring $F_{EMF}$ is the electromagnetic force $F_f$ is the fluid force $F_{preload}$ is the solenoid spring preload The electrical aspects of the solenoid valves are represented by the equation:

$$v = R\cdot i(t) + L(x)\frac{\partial i}{\partial t} + i(t)\frac{\partial L(x)}{\partial x}\cdot\frac{dx}{dt} \tag{2}$$

where R is the solenoid coil resistance, i is the solenoid coil current, L is the solenoid coil inductance, and v is the solenoid coil excitation voltage.

Finally, the electromagnetic force $F_{EMF}$ is given by the equation:

$$F_{EMF} = \frac{2\mu_0\pi N^2 i^2}{\left(\frac{4x_{sp}}{d}+\frac{l_g}{d+l_g}\right)^2} \tag{3}$$

where $\mu_0$ is the air permeability, d is the diameter of solenoid plunger, $l_g$ is the air gap, and N is the number of solenoid coil turns.

Since the design parameters of the solenoid valves 52, 54, 56, 58 are known, the dynamic response of the solenoid valves can be characterized by equations (1), (2) and (3). Certain of these parameters, such as the solenoid coil resistance R, change with temperature, and the coil temperature may be approximated by fluid temperature $T_{oil}$. The solenoid response time $\Delta t_{sol}$ is the time it takes for the plunger displacement $x_{sp}$ to reach a predetermined fully actuated displacement. Ignoring the fluid force $F_f$, ECM 60 can characterize the solenoid plunger response time as a function of the solenoid voltage λ and the fluid temperature $T_{oil}$. That is:

$$\Delta t_{sol}=f_1(v,T_{oil}) \tag{4}$$

In the hydraulic model 112, the supply pressure $P_s$ is an input, and the flow continuity equation for control chambers 64, 66, 68, 70 can be written as:

$$Q_{sc1} + Q_{sc2} - Q_{leak} = \frac{dV_1(t)}{dt} + \frac{V_1(t)}{\beta_e} \cdot \frac{dP_1}{dt} \tag{5}$$

$$Q_{sc1} = C_q \cdot a_{sc1} \cdot \sqrt{\frac{2(P_{s1} - P_{c1})}{\rho}} \tag{6}$$

$$Q_{sc2} = C_q \cdot a_{sc2} \cdot \sqrt{\frac{2(P_{s1} - P_{c1})}{\rho}} \cdot u(t - t_{sol1}) \tag{7}$$

$$V_1 = V_{10} + a_{pin} \cdot x_{pin_in} \cdot u(t - t_{lin}) + a_{pin} \cdot x_{pin_ex} \cdot u(t - t_{lex}) \tag{8}$$

where $P_{sl}$ is the supply pressure at the control chamber, assuming equal to $P_s$, u is a step function, i.e.

$$u(t - t_{sol1}) = \begin{cases} 0 & t < t_{sol1} \\ 1 & t \geq t_{sol1} \end{cases} \tag{9}$$

$t_{sol1}$ is the time instant when the solenoid valve is energized, $t_{lin}$ is the time instant when the respective intake lifter sits on the cam base circle, and is a function of crank timing, $t_{lex}$ is the time instant when the respective exhaust lifter sits on the camshaft base circle, and is a function of crank timing, and $\beta_e$ be is the equivalent bulk modulus of the engine oil. Assuming the air in the engine oil is homogeneous, the equivalent bulk modulus can be calculated by:

$$\frac{1}{\beta_e} = \frac{1}{\beta_f} + \upsilon \frac{1}{\beta_g} \tag{10}$$

where $\beta_f$ is the bulk modulus of the engine oil, $\beta_g$ is the adiabatic bulk modulus, which is 1.4 P for air. $\upsilon$ is the air ratio, i.e. the ratio of air volume to the total volume. Additionally, $Q_{leak}$ is the leakage flow, and is given by:

$$Q_{leak} = \frac{(C_{\text{rad}})^3 \cdot \Delta P \cdot d_m \cdot \pi}{12\mu_m \cdot l} \tag{11}$$

where $C_{rad}$ is the radial clearance, $$\frac{d_m}{l}$$

is the ratio of clearance's mean diameter to the land length, and $\mu_m$ is the mean absolute viscosity.

Assuming the plenum 62 has uniform pressure $P_s$, then equation (8) can be modified as follows to take into account the pressure fluctuation as a result of intake and exhaust lifter locking pins moving at different time instants.

$$V_1 = V_{10} + a_{pm} \cdot \sum_{i=1,4,6,7} x_{\text{ipin_in}} \cdot u(t - t_{in}) + a_{pin} \cdot \sum_{j=1,4,6,7} x_{\text{ipin_ex}} \cdot u(t - t_{jex}) \tag{12}$$

The hydraulic system response time $\Delta t_h$ is simply the time for the control pressure to rise to a critical level determined by design criteria, and can be characterized as a function of the supply pressure $P_s$ and the fluid temperature $T_{oil}$. That is:

$$\Delta t_h = f_2(P_s, T_{oil}) \tag{13}$$

The locking pin model considers the pin mechanism 12 as a mass-spring-damper system described by the dynamic equations:

$$\begin{cases} m_{pin} \cdot \ddot{x}_1 + B_{pin} \cdot \dot{x}_1 + K_{pin} \cdot (x_1 + x_2) = F_1 \\ m_{pin} \cdot \ddot{x}_2 + B_{pin} \cdot \dot{x}_2 + K_{pin} \cdot (x_1 + x_2) = F_2 \end{cases} \tag{14}$$

where $x_1$ and $x_2$ are the displacements of shoes 22 and 24, and forces $F_1$ and $F_2$ are the hydraulic forces applied to shoes 22 and 24. The transfer functions relating $x_1$ and $x_2$ to the input forces $F_1$ and $F_2$ are as follows:

$$x_1(s) = \frac{(m_{pin}s^2 + B_{pin}s + K_{pin}) \cdot F_1(s) - K_{pin} \cdot F_2(s)}{m_{pin}^2 s^4 + 2B_{pin}m_{pin}s^3 + (B_{pin}^2 + 2K_{pin}m_{pin})s^2 + 2K_{pin}B_{pin}} \tag{15}$$

$$x_2(s) = \frac{(m_{pin}s^2 + B_{pin}s + K_{pin}) \cdot F_2(s) - K_{pin} \cdot F_1(s)}{m_{pin}^2 s^4 + 2B_{pin}m_{pin}s^3 + (B_{pin}^2 + 2K_{pin}m_{pin})s^2 + 2K_{pin}B_{pin}} \tag{16}$$

$$F_1 = P_c \cdot a_{pin} - F_{preload} \tag{17}$$

$$F_2 = (P_c \cdot a_{pin} - F_{preload}) \cdot u(t - T) \tag{18}$$

where $F_{preload}$ is the pin spring preload, T is the time delay between pressure forces $F_1$ and $F_2$, and s is the Laplace operator. If T is small enough, then $e^{-Ts} \approx 1$. Then the pin motion equations (15) and (16) are simplified as:

$$x_1(s) = -x_2(s) = \frac{1}{m_{pin}s^2 + B_{pin}s + 2K_{pin}} \cdot F_1(s) \tag{19}$$

Equation (17) indicates that if the fluid enters the left hand side of cavity 26 fast enough that the fluid force can be considered to act on both pins simultaneously, the two-shoe spring system can be modeled by a simplified one shoe system with twice the equivalent spring constant. The locking pin response time $\Delta t_p$ is the time it takes for the shoes 22, 24 to reach the stops 36, 38 once the control pressure rises to the critical pressure level, and can be characterized by ECM 60 as a function of control pressure Pc and fluid pressure $T_{oil}$. That is:

$$\Delta t_p = f_3(P_c, T_{oil}) \tag{20}$$

The total response time of the deactivation hardware system is then defined as:

$$Q = \Delta t_{sol} + \Delta t_h + \Delta t_p \tag{21}$$

Finally, a fourth response time to consider is the ECM response time $\Delta t_s$, which may be negligible compared to the other response times.

Figure 3:
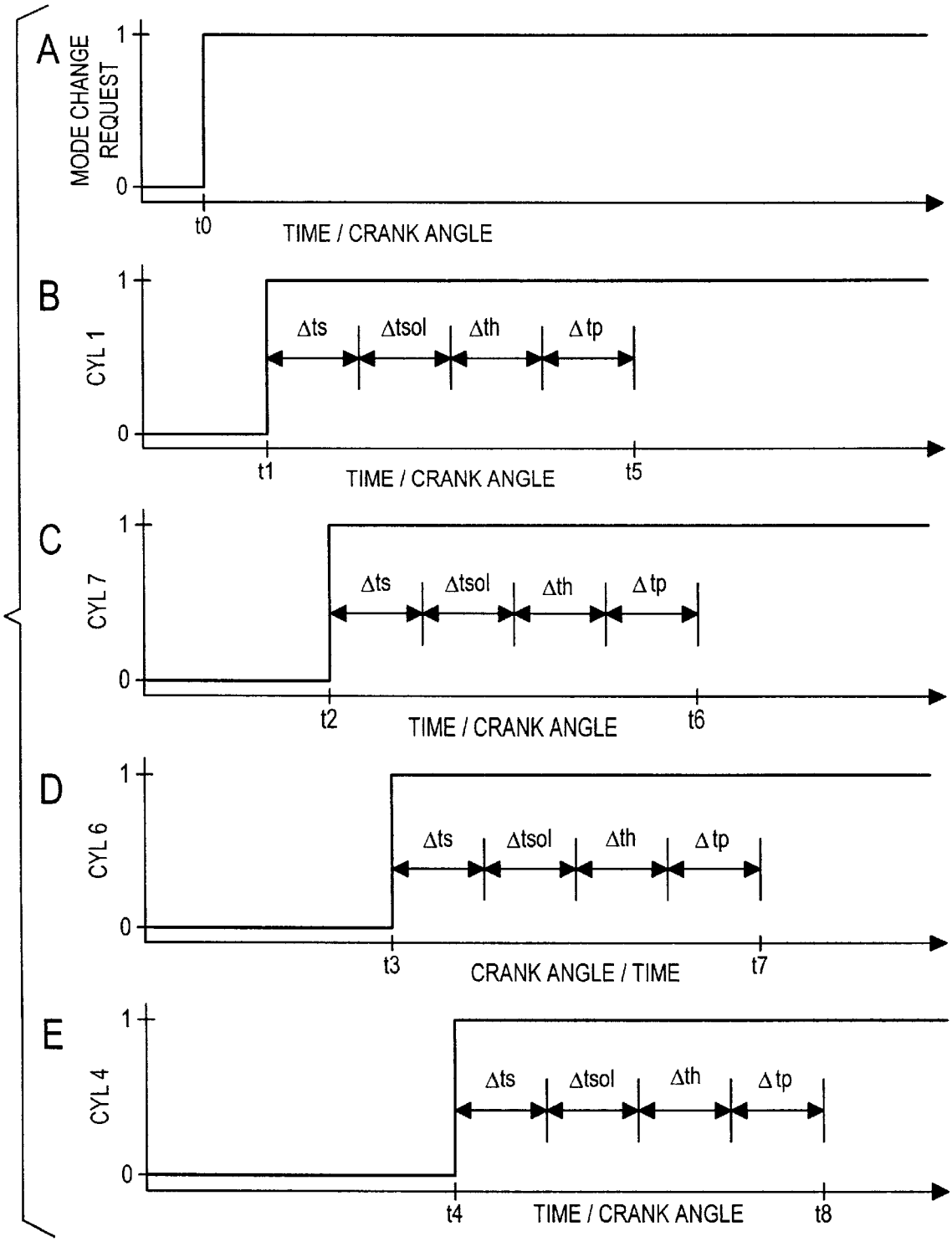
FIG. 3, Graphs A–E, depict an example of cylinder deactivation according to this invention.

In summary, ECM 60 estimates the overall response time for each of the specified engine cylinders as the sum of four constituent response times as graphically depicted in FIG. 3. Referring to FIG. 3, a mode change request occurs at time t0, causing ECM 60 to determine the overall response time, and to determine if there is sufficient time to complete the requested cylinder deactivation by the end of the next engine cycle window of opportunity. In the example of FIG. 3, there is sufficient time, and a command to energize the solenoid S1 is issued at time t1, resulting in complete activation of the corresponding locking pin mechanism 12 at time t5.

Similarly, commands for energizing the solenoids S4, S6 and S7 are issued at times t2, t3 and t4, respectively, resulting in complete activation of the respective locking pin mechanisms at times t6, t7 and t8.

Figure 4:
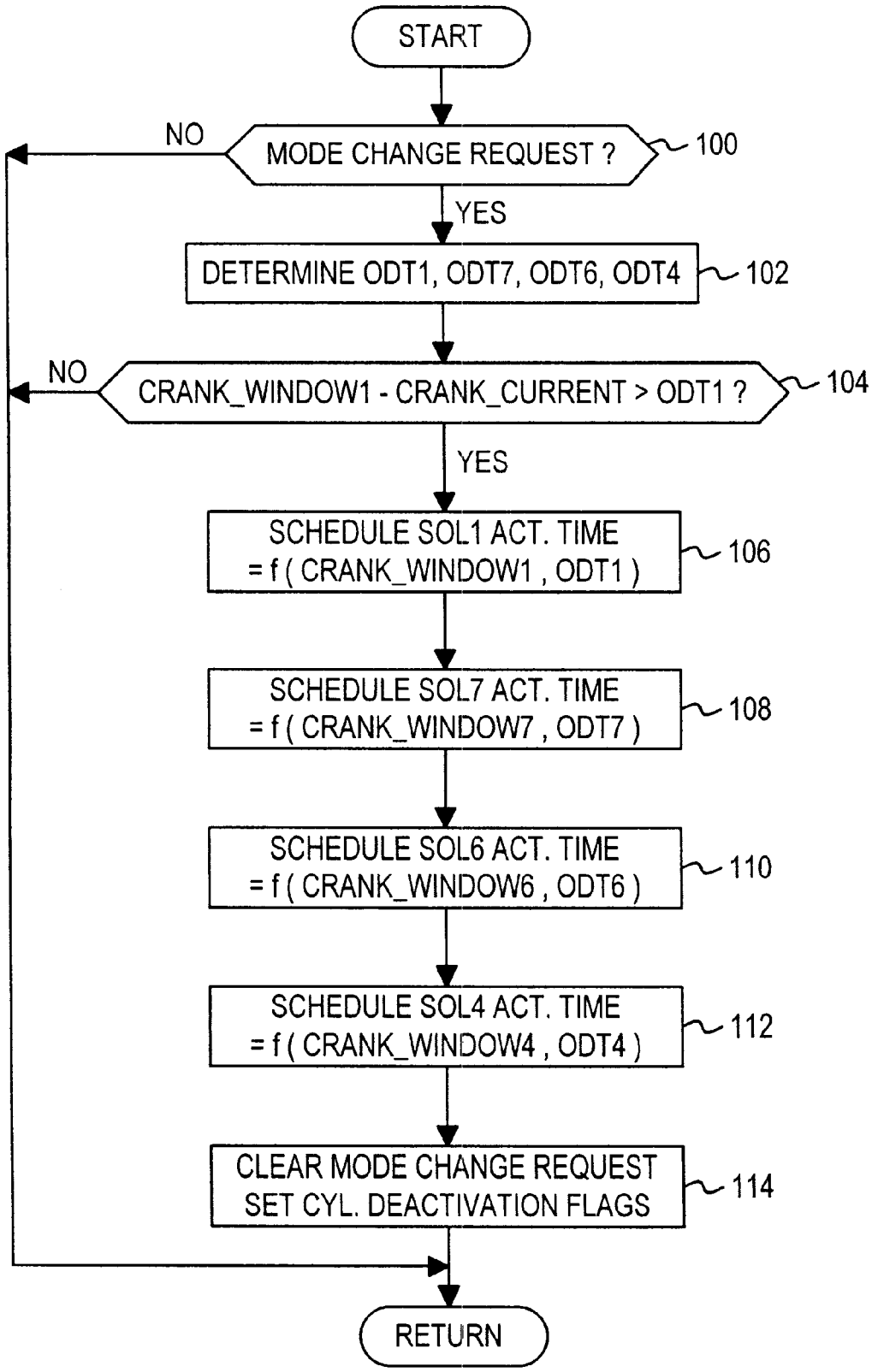
FIG. 4 is a flow diagram of a software routine executed by the control unit of FIG. 1 in carrying out a cylinder deactivation control according to this invention.

A flow diagram representative of a software routine periodically executed by ECM 60 for carrying out the above-described control is depicted in FIG. 4. Referring to FIG. 4, the block 100 initially determines if a mode change request (that is, a signal requesting deactivation of specified engine cylinders) has occurred. If not, the routine is exited; if so, the block 102 is executed to determine the overall delay times ODT1, ODT7, ODT6 and ODT4 for cylinder numbers 1, 7, 6 and 4. In practice, the overall delay times for each cylinder may be assumed to be equal for any given set of environmental and engine operating conditions. The delay times may be determined in a straight-forward manner based on equations 1–3, 5–12, 14 and 17–19 above, or may be determined by table-look-up based on $T_{oil}$, V, Ps and Pc as indicated in equations 4, 13 and 20. In the latter case, the table values are determined by solving the equations 1–3, 5–12, 14 and 17–19 off-line for various combinations of $T_{oil}$, V and Ps, as will be well understood by those skilled in the art. The block 104 then determines if there is sufficient time to complete the deactivation of cylinder number 1 in the next crank window of opportunity; that is, whether the difference between the end of the crank window (CRANK_WINDOW1) and the current crank angle (CRANK_CURRENT) is greater than the overall delay time ODT 1. If not, the routine is exited, and cylinder deactivation is delayed until the following window of opportunity. If so, the blocks 106, 108, 110 and 112 are executed to schedule the respective solenoid activation times based on the determined delay times and the respective crank windows, and the block 114 is executed to clear the mode change request, and to set flags indicating that the cylinder deactivation commands have been issued.

While the present invention has been described in reference to the illustrated embodiments, it is expected that various modifications in addition to those mentioned above will occur to those skilled in the art. For example, the described control is applicable to other types of engines and other control strategies including a bank control in which the specified engine cylinders are concurrently deactivated instead of consecutively deactivated. Thus, it will be understood that control method incorporating these and other modifications may fall within the scope of this invention, which is defined by the appended claims.

What is claimed is:

1. A control method for an actuator that disables a valve lifter for a specified engine cylinder to deactivate such cylinder, said actuator including a solenoid-operated fluid valve, a hydraulic sub-system having a control chamber, and a hydraulically actuated locking mechanism coupled to said control chamber, wherein application of a system voltage to said solenoid-operated fluid valve couples a pressurized system fluid to said control chamber for application to said hydraulically actuated locking mechanism to disable said valve lifter, the control method comprising the steps of:

estimating a first response time corresponding to a time required for said solenoid-operated fluid valve to couple the system fluid to said control chamber following the application of said system voltage to said solenoid-operated fluid valve;

estimating a second response time corresponding to a time required for a fluid pressure in said control chamber to reach a predetermined level once the solenoid-operated fluid valve couples the system fluid to said control chamber;

estimating a third response time corresponding to a time required for said hydraulically actuated locking mechanism to disable said engine valve lifter once the fluid pressure in said control chamber reaches said predetermined level;

determining an overall response time of said actuator according to a sum of said first, second and third response times; and applying said system voltage to said solenoid-operated fluid valve at a time based on the determined overall response time, relative to a desired time for disabling said valve lifter.

2. The control method of claim 1, wherein the step of estimating said first response time includes the steps of:

modeling a displacement of a fluid control element of said solenoid-operated fluid valve in response to the application of said system voltage; and estimating said first response time as an elapsed time when said modeled displacement reaches a predetermined displacement.

3. The control method of claim 2, including the step of:

characterizing said first response time as a function of said system voltage and a temperature of said system fluid.

4. The control method of claim 1, wherein the step of estimating said second response time includes the steps of:

modeling the fluid pressure in said control chamber in response to the coupling of said system fluid to said control chamber; and estimating said second response time as an elapsed time when said modeled fluid pressure reaches said predetermined level.

5. The control method of claim 4, including the step of:

characterizing said second response time as a function of a pressure of said system fluid and a temperature of said system fluid.

6. The control method of claim 1, wherein the step of estimating said third response time includes the steps of:

modeling a displacement of said hydraulically actuated locking mechanism in response to fluid pressure in said control chamber above said predetermined level; and estimating said third response time as an elapsed time when said modeled displacement reaches a predetermined displacement.

7. The control method of claim 6, including the step of:

characterizing said third response time as a function of the fluid pressure in said control chamber and a temperature of said system fluid.

* * * * *